US006268332B1

(12) United States Patent
Baker et al.

(10) Patent No.: US 6,268,332 B1
(45) Date of Patent: Jul. 31, 2001

(54) LOW SOLVENT RINSE-ADDED FABRIC SOFTNERS HAVING INCREASED SOFTNESS BENEFITS

(75) Inventors: Ellen Schmidt Baker; Rebecca Gayl Baker, both of Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/554,968

(22) PCT Filed: Nov. 24, 1998

(86) PCT No.: PCT/US98/25077

§ 371 Date: May 23, 2000

§ 102(e) Date: May 23, 2000

(87) PCT Pub. No.: WO99/27046

PCT Pub. Date: Jun. 3, 1999

Related U.S. Application Data

(60) Provisional application No. 60/066,424, filed on Nov. 24, 1997.

(51) Int. Cl.[7] ..... C11D 1/835
(52) U.S. Cl. ..... 510/524
(58) Field of Search ..... 510/522, 524, 510/525

(56) References Cited

U.S. PATENT DOCUMENTS

| | | | | |
|---|---|---|---|---|
| 4,497,716 | | 2/1985 | Tai | 252/8.8 |
| 4,828,757 | * | 5/1989 | Naylor et al. | 252/544 |
| 5,476,598 | | 12/1995 | Schramm, Jr. et al. | 252/8.8 |
| 5,679,331 | | 10/1997 | Hague et al. | 424/70.19 |
| 5,693,605 | * | 12/1997 | Isobe et al. | 510/499 |
| 5,874,396 | * | 2/1999 | Littig et al. | 510/504 |

FOREIGN PATENT DOCUMENTS

| | | |
|---|---|---|
| 0 799 887 | 10/1997 | (EP) . |
| WO 97/03170 | 1/1997 | (WO) . |
| WO 97/23590 | 7/1997 | (WO) . |

* cited by examiner

*Primary Examiner*—John Hardee
(74) *Attorney, Agent, or Firm*—R. S. Echler, Sr.; K. W. Zerby; S. W. Miller

(57) ABSTRACT

The present invention relates to rinse-added fabric softening compositions, including translucent or clear liquid compositions. The compositions of the present invention comprise a polyoxyalkylene alkyl amide surface active agent which provides increased softness to fabrics, increased stability and formulatability to dispersed phase liquids, and provide for a reduced level of principal solvent when formulated into translucent or clear liquid compositions. In the most basic form, the compositions of the present invention comprise: a) from about 1% to about 80% by weight, of a fabric softening active; b) less than about 15% by weight, of a principal solvent, said principal solvent having a ClogP of from about 0.15 to about 1; c) from about 0.5% to about 10% by weight, of a polyoxyalkylene alkyl amide surface active agent; and d) the balance carriers and adjunct ingredients.

23 Claims, No Drawings

LOW SOLVENT RINSE-ADDED FABRIC SOFTNERS HAVING INCREASED SOFTNESS BENEFITS

This application is a 371 of PCT/US98/25077 filed Nov. 24, 1998, which claims benefit Prov. No. 60/066,424 filed Nov. 24, 1997.

FIELD OF THE INVENTION

The present invention relates to rinse-added fabric softening compositions, including translucent or clear liquid compositions. The compositions of the present invention have a low level or nil principal solvent while providing enhanced softness to fabrics.

BACKGROUND OF THE INVENTION

Clear, colorless or translucent liquids which can be suitably colored by the formulator are desirable embodiments of rinse-added fabric softener compositions. Typically these compositions require beyond any fabric softener actives, up to 20% by weight of one or more principal solvents inter alia 1,2-hexanediol 2-ethyl-1,2-hexanediol and 2,2,4-trimethyl-1,3-pentanediol (TMPD). In addition, not all fabric softener actives are compatible with all principal solvents. This fact, taken together with the high cost and low supply capacity of certain principal solvents, has encumbered the formulation of clear colorless liquid fabric softener compositions.

Accordingly, there remains a need in the art for rinse-added fabric softener compositions which are translucent and/or colorless and which avoids the use of high levels of principal solvent. In addition, there is a need for efficient softness boosters for all rinse-added fabric softener compositions, for example, dispersed phase liquids as well as clear isotropic liquids.

SUMMARY OF THE INVENTION

The present invention meets the aforementioned needs in that it has been surprisingly discovered that the use of certain primary and secondary polyoxyalkylene alkylamide surface active agents provide increased fabric softness in both dispersed phase and clear or translucent isotropic formulations. Indeed, the mono- and di-polyoxyalkylene alkyl amide surface active agents of the present invention also provide easier processability and formulatability in dispersed phase rinse-added compositions.

It has also been surprisingly discovered that certain primary and secondary polyoxyalkylene alkylamide surface active agents can be substituted for the principal solvents of clear, translucent fabric softening compositions thereby requiring a lower level of, and in some instances, nil principal solvent.

The first aspect of the present invention relates to rinse-added fabric softening compositions comprising:

a) from about 1% to about 80% by weight, of a fabric softening active;

b) less than about 15% by weight, of a principal solvent, said principal solvent having a ClogP of from about 0.15 to about 1;

c) from about 0.5% to about 10% by weight, of a polyoxyalkylene alkyl amide surface active agent; preferably having the formula:

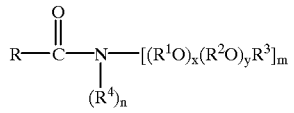

wherein R is $C_7$–$C_{21}$ linear alkyl, $C_7$–$C_{21}$ branched alkyl, $C_7$–$C_{21}$ linear alkenyl, $C_7$–$C_{21}$ branched alkenyl, and mixtures thereof; $R^1$ is ethylene; $R^2$ is $C_3$–$C_4$ linear alkyl, $C_3$–$C_4$ branched alkyl, and mixtures thereof; $R^3$ is hydrogen, $C_1$–$C_4$ linear alkyl, $C_3$–$C_4$ branched alkyl, and mixtures thereof; $R^4$ is hydrogen, $C_1$–$C_4$ linear alkyl, $C_3$–$C_4$ branched alkyl, and mixtures thereof; m is 1 or 2, n is 0 or 1, provided that when m is 1 n is 1 and when m is 2 n is 0; x is from 0 to about 50; y is from 0 to about 10; and d) the balance carriers and adjunct ingredients.

The present invention further relates to a process for making a rinse-added fabric softener composition with a low to zero level of principal solvent, comprising the step of adding an amide surfactant to a fabric softener active-containing composition.

The present invention also relates to methods for providing increased fabric softness to fabric, said method comprising the step of contacting fabric with an amide surfactant comprising composition according to the present invention. These and other objects, features and advantages will become apparent to those of ordinary skill in the art from a reading of the following detailed description and the appended claims.

All percentages, ratios and proportions herein are by weight, unless otherwise specified. All temperatures are in degrees Celsius (°C.) unless otherwise specified. All documents cited are in relevant part, incorporated herein by reference.

DETAILED DESCRIPTION OF THE INVENTION

The present invention relates to rinse-added fabric softening compositions having increased softness. The increased softness benefit is provided by the addition of one or more polyoxyalkylene alkyl amide surface active agents to dispersed phase or isotropic softener compositions. In addition, compositions which are clear, translucent liquids, need less principal solvent to maintain an isotropic formulation. These latter compositions may be formulated to be colorless solutions or the formulator may tint or color the compositions to satisfy the aesthetic decor indicated by the consumer. The compositions the present invention comprise polyoxyalkylene alkylamide surface active agents which can replace some or all of the principal solvent which typically comprises clear and/or translucent liquid fabric softeners. The level of principal solvent present in the compositions of the present invention is typically less than about 15%, preferably less than about 12%, more preferably less than about 9% most preferably less than about 5% by weight. Although compositions comprising nil principal solvent are achievable by the present invention, the presence of one or more principal solvents at a level of from about 0.5% to about 10% may be desirable by the formulator. For example, in order to formulate one or more ingredients, or to provide a homogeneous admixture of ingredients (e.g., colorants), one or more principal solvents may be used as a cosolvent or carrier during processing. Therefore, the presence of a principal solvent may be due to the fact that said principal solvent was carried into the composition as part of a feedstock composition. In addition, some level of principal solvent may be necessary to maintain product clarity at low temperatures.

The following describe the required ingredients of the present invention.

Polyoxyalkylene Alkylamide Surface Active Agent

The present invention comprises from about 0.5%, preferably from about 1.5% to about 10%, preferably to about 5%, more preferably to about 4%, most preferably to about 3% by weight, of one or more polyoxyalkylene alkyl amide surface active agent.

The nonionic surfactants suitable for use in the present invention have the formula:

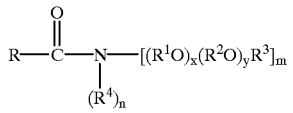

wherein R is $C_7$–$C_{21}$ linear alkyl, $C_7$–$C_{21}$ branched alkyl, $C_7$–$C_{21}$ linear alkenyl, $C_7$–$C_{21}$ branched alkenyl, and mixtures thereof. Preferably the nonionic surfactants of the present invention are derived from naturally occurring feedstocks, therefore said nonionic surfactants comprise acyl units having the formula:

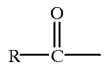

wherein said acyl unit is derived from a source of triglyceride selected from the group consisting of tallow, partially hydrogenated tallow, lard, coconut oil, partially hydrogenated coconut oil, palm kernel oil, hydrogenated palm kernel oil, canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, and mixtures thereof. Further preferred sources of triglyceride for the acyl unit are synthetic triglyceride feedstocks, for example, triglycerides which are prepared via chemical reaction or other process rather than being derived from a natural source. More preferred feedstocks for said acyl units are tallow, partially hydrogenated tallow, coconut oil, partially hydrogenated coconut oil, canola oil, hydrogenated canola oil, synthetic triglycerides, and mixtures thereof. A preferred triglyceride source is tri-oleyl triglycerides.

$R^1$ is ethylene; $R^2$ is $C_3$–$C_4$ linear alkyl, $C_3$–$C_4$ branched alkyl, and mixtures thereof; preferably $R^2$ is 1,2-propylene. Nonionic surfactants which comprise a mixture of $R^1$ and $R^2$ units preferably comprise from about 4 to about 12 ethylene units in combination with from about 1 to about 4 1,2-propylene units. The units may be alternating, or grouped together in any combination suitable to the formulator. Preferably the ratio of $R^1$ units to $R^2$ units is from about 4:1 to about 8:1. Preferably an $R^2$ units (i.e. 1,2-propylene) is attached to the nitrogen atom followed by the balance of the chain comprising from 4 to 8 ethylene units.

$R^3$ is hydrogen, $C_1$–$C_4$ linear alkyl, $C_3$–$C_4$ branched alkyl, and mixtures thereof; preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the $R^4$ unit is absent and is instead replaced by a $-[(R^1O)_x(R^2O)_yR^3]$ unit.

The index m is 1 or 2, the index n is 0 or 1, provided that when m is equal to 1, n is equal to 1; and when m is 2 n is 0; preferably m is equal to 1 and n is equal to one, resulting in one $-[(R^1O)_x(R^2O)_yR^3]$ unit and $R^4$ being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all of the alkyleneoxy units are ethyleneoxy units. Those skilled in the art of ethoxylated polyoxyalkylene alkyl amide surface active agents will recognized that the values for the indices x and y are average values and the true values may range over several values depending upon the process used to alkoxylate the amides.

Suitable means for preparing the polyoxyalkylene alkylamide surface active agents of the present invention can be found in "Surfactant Science Series", Editor Martin Schick, Volume 1, Chapter 8 (1967) and Volume XIX, Chapter 1 (1987) included herein by reference.

Quaternary Ammonium Fabric Softening Active Compounds (DEOA's)

The preferred fabric softening actives according to the present invention are

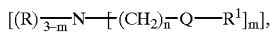

quaternary ammonium compounds having the formula:

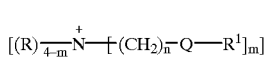

and mixtures thereof, wherein each R is independently $C_1$–$C_6$ alkyl, $C_1$–$C_6$ hydroxyalkyl, benzyl, and mixtures thereof; $R^1$ is preferably $C_{11}$–$C_{22}$ linear alkyl, $C_{11}$–$C_{22}$ branched alkyl, $C_{11}$–$C_{22}$ linear alkenyl, $C_{11}$–$C_{22}$ branched alkenyl, and mixtures thereof; Q is a carbonyl moiety independently selected from the units having the formula:

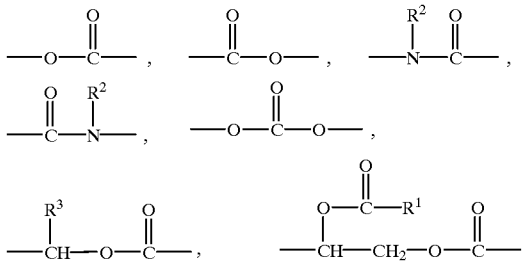

wherein $R^2$ is hydrogen, $C_1$–$C_4$ alkyl, preferably hydrogen; $R^3$ is $C_1$–$C_4$ alkyl, preferably hydrogen or methyl; preferably Q has the formula:

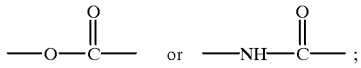

X is a softener compatible anion, preferably the anion of a strong acid, for example, chloride, bromide, methylsulfate, ethylsulfate, sulfate, nitrate and mixtures thereof, more preferably chloride and methyl sulfate. The anion can also, but less preferably, carry a double charge, in which case $X^{(-)}$ represents half a group. The index m has a value of from 1 to 3; the index n has a value of from 1 to 4, preferably 2 or 3, more preferably 2.

One embodiment of the present invention provides for amines and quaternized amines having two or more different values for the index n per molecule, for example, a softener active prepared from the starting amine methyl(3-aminopropyl)(2-hydroxyethyl)amnine.

More preferred softener actives according to the present invention have the formula:

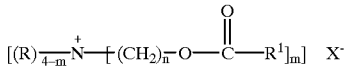

wherein the unit having the formula:

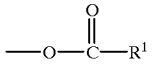

is a fatty acyl moiety. Suitable fatty acyl moieties for use in the softener actives of the present invention are derived from sources of triglycerides including tallow, vegetable oils and/or partially hydrogenated vegetable oils including inter alia canola oil, safflower oil, peanut oil, sunflower oil, corn oil, soybean oil, tall oil, rice bran oil.

The $R^1$ units are typically mixtures of linear and branched chains of both saturated and unsaturated aliphatic fatty acids, an example of which (canola oil), is described in Table I herein below.

TABLE I

| Fatty acyl unit | % |
|---|---|
| C14 | 0.1 |
| C16 | 5.4 |
| C16:1 | 0.4 |
| C18 | 5.7 |
| C18:1 | 67.0 |
| C18:2 | 13.5 |
| C18:3 | 2.7 |
| C20 | 0.5 |
| C20:1 | 4.6 |

The formulator, depending upon the desired physical and performance properties of the final fabric softener active, can choose any of the above mentioned sources of fatty acyl moieties, or alternatively, the formulator can mix sources of triglyceride to form a "customized blend". However, those skilled in the art of fats and oils recognize that the fatty acyl composition may vary, as in the case of vegetable oil, from crop to crop, or from variety of vegetable oil source to variety of vegetable oil source. DEQA's which are prepared using fatty acids derived from natural sources are preferred.

A preferred embodiment of the present invention provides softener actives comprising $R^1$ units which have at least about 3%, preferably at least about 5%, more preferably at least about 10%, most preferably at least about 15% $C_{11}$–$C_{22}$ alkenyl, including polyalkenyl (polyunsaturated) units inter alia oleic, linoleic, linolenic.

For the purposes of the present invention the term "mixed chain fatty acyl units" is defined as "a mixture of fatty acyl units comprising alkyl and alkenyl chains having from 10 carbons to 22 carbon atoms including the carbonyl carbon atom, and in the case of alkenyl chains, from one to three double bonds, preferably all double bonds in the cis configuration". With regard to the $R^1$ units of the present invention, it is preferred that at least a substantial percentage of the fatty acyl groups are unsaturated, e.g., from about 25%, preferably from about 50% to about 70%, preferably to about 65%. The total level of fabric softening active containing polyunsaturated fatty acyl groups can be from about 3%, preferably from about 5%, more preferably from about 10% to about 30%, preferably to about 25%, more preferably to about 18%. As stated herein above cis and trans isomers can be used, preferably with a cis/trans ratio is of from 1:1, preferably at least 3:1, and more preferably from about 4:1 to about 50:1, more preferably about 20:1, however, the minimum being 1:1.

The level of unsaturation contained within the tallow, canola, or other fatty acyl unit chain can be measured by the Iodine Value (IV) of the corresponding fatty acid, which in the present case should preferably be in the range of from 5 to 100 with two categories of compounds being distinguished, having a IV below or above 25.

Indeed, for compounds having the formula:

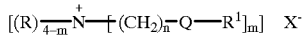

derived from tallow fatty acids, when the Iodine Value is from 5 to 25, preferably 15 to 20, it has been found that a cis/trans isomer weight ratio greater than about 30/70, preferably greater than about 50/50 and more preferably greater than about 70/30 provides optimal concentrability.

For compounds of this type made from tallow fatty acids having a Iodine Value of above 25, the ratio of cis to trans isomers has been found to be less critical unless very high concentrations are needed. A further preferred embodiment of the present invention comprises DEQA's wherein the average Iodine Value for $R^1$ is approximately 45.

The $R^1$ units suitable for use in the isotropic liquids present invention can be further characterized in that the Iodine Value (IV) of the parent fatty acid, said IV is preferably from about 10, more preferably from about 50, most preferably from about 70, to a value of about 140, preferably to about 130, more preferably to about 115. However, formulators, depending upon which embodiment of the present invention they choose to execute, may wish to add an amount of fatty acyl units which have Iodine Values outside the range listed herein above. For example, "hardened stock" (IV less than or equal to about 10) may be combined with the source of fatty acid admixture to adjust the properties of the final softener active.

A prefered source of fatty acyl units, especially fatty acyl units having branching, for example, "Guerbet branching", methyl, ethyl, etc. units substituted along the primary alkyl chain, synthetic sources of fatty acyl units are also suitable. For example, the formulator may with to add one or more fatty acyl units having a methyl branch at a "non-naturally occuring" position, for example, at the third carbon of a $C_{17}$ chain. What is meant herein by the term "non-naturally occuring" is "acyl units whihc are not found in significant (greater than about 0.1 %) quantities is common fats and oils which serve as feedstocks for the source of triglycerides described herein." If the desired branched chain fatty acyl unit is unavailable from readily available natural feedstocks, therefore, synthetic fatty acid can be suitably admixed with other synthetic materials or with other natural triglyceride derived sources of acyl units.

Amines which can be used to prepare the preferred fabric softening actives of the present invention have the formula:

$$(R)_{3-m}N-[(CH_2)_n-Z]_m$$

wherein R is the same as defined herein above; each Z is independently selected from the group consisting of —OH. —$CHR^3OH$, —$CH(OH)CH_2OH$, —$NH_2$, and mixtures thereof; preferably —OH, —$NH_2$, and mixtures thereof; $R^3$ is $C_1$–$C_4$ alkyl, preferably methyl; the indices m and n are the same as defined hereinabove.

Non-limiting examples of preferred amines which are used to form the DEQA fabric softening actives according to the present invention include methyl bis(2-hydroxyethyl) amine having the formula:

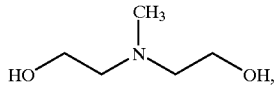

methyl bis(2-hydroxypropyl)amine having the formula:

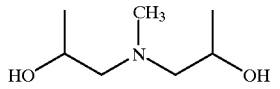

methyl (3-aminopropyl) (2-hydroxyethyl)amine having the formula:

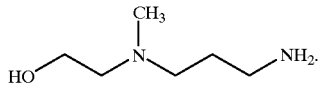

methyl bis(2-aminoethyl)amine having the formula:

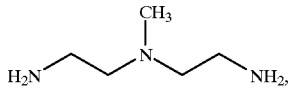

triethanol amine having the formula:

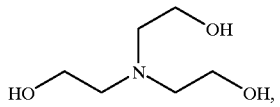

bis(2-aminoethyl) ethanolamine having the formula:

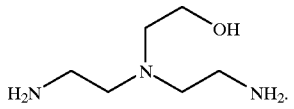

The above examples include symmetrical as well as unsymmetrical and mixed amines. For the purposes of the present invention the term "mixed" amine is defined as "amines having different carbon chain lengths on two or more branches", that is the value of the index n is different from chain to chain. An example of a mixed amine is methyl (3-aminopropyl) (2-hydroxyethyl)amine. For the purposes of the present invention the term "unsymetrical amine" is defined as "amines having different substituents from one chain to the next", that is one chain may comprise a hydroxy unit, while another chain may comprise an amine unit.

For the purposes of the present invention, R moieties which are introduced during the quaternization step are preferably methyl. In the case of amines having the formula:

$$R-N-[(CH_2)_n-Z]_2$$

R is preferably the same moiety (i.e. methyl) which is introduced during the quaternization step. For example, a methyl amine having the formula:

$$CH_3-N-[(CH_2)_n-Z]_2$$

after reaction with a suitable source of fatty acyl units, is preferably quaternized to the softener active having the general formula:

$$[(CH_3)_2-\overset{+}{N}-[(CH_2)_n-Q-R^1]_2]\quad X^-.$$

In one embodiment of the present invention, the fabric softening active precursor amine mixture is not fully quaternized, that is, some free amine having the general formula:

$$(R)_{3-m}N-[(CH_2)_n-Q-R^1]_m$$

is still present in the final fabric softener mixture.

A yet further embodiment of the present invention comprises an amine of the formula:

$$(R)_{3-m}N-[(CH_2)_n-Z]_m$$

wherein not all of the Z units are fully reacted with a fatty acyl moiety thereby leaving an amount of amine and/or quaternized ammonium compound in the final fabric softener active admixture having one or more Z units unreacted and thereby not transformed into an ester or amide.

The following are examples of preferred softener actives according to the present invention.

- N,N-di(tallowyl-oxy-ethyl)-N,N-dimethyl ammonium chloride;
- N,N-di(canolyl-oxy-ethyl)-N,N-dimethyl ammonium chloride;
- N,N-di(tallowyl-oxy-ethyl)-N-methyl, N-(2-hydroxyethyl) ammonium methyl sulfate;
- N,N-di(canolyl-oxy-ethyl)-N-methyl, N-(2-hydroxyethyl) ammonium methyl sulfate;
- N,N-di(tallowylamidoethyl)-N-methyl, N-(2-hydroxyethyl) ammonium methyl sulfate;
- N,N-di(2-tallowyloxy-2-oxo-ethyl)-N,N-dimethyl ammonium chloride;
- N,N-di(2-canolyloxy-2-oxo-ethyl)-N,N-dimethyl ammonium chloride;
- N,N-di(2-tallowyloxyethylcarbonyloxyethyl)-N,N-dimethyl ammonium chloride;
- N,N-di(2-canolyloxyethylcarbonyloxyethyl)-N,N-dimethyl ammonium chloride;
- N-(2-tallowoyloxy-2-ethyl)-N-(2-tallowyloxy-2-oxo-ethyl)-N,N-dimethyl ammonium chloride;
- N-(2-canolyloxy-2-ethyl)-N-(2-canolyloxy-2-oxo-ethyl)-N,N-dimethyl ammonium chloride;

N,N,N-tri(tallowyl-oxy-ethyl)-N-methyl ammonium chloride;

N,N,N-tri(canolyl-oxy-ethyl)-N-methyl ammonium chloride;

N-(2-tallowyloxy-2-oxoethyl)-N-(tallowyl)-N,N-dimethyl ammonium chloride;

N-(2-canolyloxy-2-oxoethyl)-N-(canoyly)-N,N-dimethyl ammonium chloride;

1,2-ditallowyloxy-3-N,N,N-trimethylammoniopropane chloride; and 1,2-dicanolyloxy-3-N,N,N-trimethylanumoniopropane chloride;

and mixtures of the above actives.

Particularly preferred is N,N-di(tallowoyl-oxy-ethyl)-N,N-dimethyl ammonium chloride, where the tallow chains are at least partially unsaturated and N,N-di(canoloyl-oxy-ethyl)-N,-dimethyl ammonium chloride. N,N-di(tallowyl-oxy-ethyl)-N-methyl, N-(2-hydroxyethyl) ammonium methyl sulfate; N,N-di(canolyl-oxy-ethyl)-N-methyl, N-(2-hydroxyethyl) ammonium methyl sulfate; and mixtures thereof.

Still other suitable quaternary ammonium fabric softening compounds for use herein are cationic nitrogenous salts having two or more long chain acyclic aliphatic $C_8$–$C_{22}$ hydrocarbon groups or one said group and an arylalkyl group which can be used either alone or as part of a mixture are selected from the group consisting of:

(i) acyclic quaternary ammonium salts having the formula:

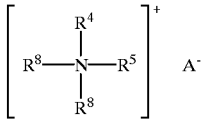

wherein $R^4$ is an acyclic aliphatic $C_8$–$C_{22}$ hydrocarbon group, $R^5$ is a $C_1$–$C_4$ saturated alkyl or hydroxyalkyl group, $R^8$ is selected from the group consisting of $R^4$ and $R^5$ groups, and A– is an anion defined as above;

(ii) diamino alkoxylated quaternary ammonium salts having the formula:

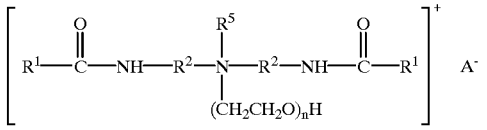

wherein n is equal to 1 to about 5, and $R_1$, $R^2$, $R^5$ and A– are as defined above;

(iii) mixtures thereof.

Examples of the above class cationic nitrogenous salts are the well-known dialkyldi methylammonium salts such as ditallowdimethylammonium chloride, ditallowdimethylammonium methylsulfate, di(hydrogenatedtallow) dimethylammonium chloride, distearyldimethylammonium chloride, dibehenyldimethylammonium chloride. Di(hydrogenatedtallow)di methylammonium chloride and ditallowdimethylanmmonium chloride are preferred. Examples of commercially available dialkyldimethyl ammonium salts usable in the present invention are di(hydrogenatedtallow)dimethylammonium chloride (trade name Adogen® 442), ditallowdimethylammonium chloride (trade name Adogen® 470. Praepagen® 3445), distearyl dimethylammonium chloride (trade name Arosurf® TA-100), all available from Witco Chemical Company. Dibehenyldimethylammonium chloride is sold under the trade name Kemamine Q-2802C by Humko Chemical Division of Witco Chemical Corporation. Dimethylstearylbenzyl ammonium chloride is sold under the trade names Varisoft® SDC by Witco Chemical Company and Ammonyx® 490 by Onyx Chemical Company.

Amine Fabric Softening Active Compound

Suitable amine fabric softening compounds for use herein, which may be in amine form or cationic form are selected from:

(i) Reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines.

The preferred Component (i) is a nitrogenous compound selected from the group consisting of the reaction product mixtures or some selected components of the mixtures.

One preferred Component (i) are reaction products of substantially unsaturated and/or branched chain higher fatty acids with dialkylenetriamines in, e.g., a molecular ratio of about 2:1, said reaction products containing compounds of the formula:

$$R_1—C(O)—NH—R^2—NH—R^2—NH—C(O)—R^1$$

wherein each $R^1$ and $R^2$ are defined as above, and subsequently neutralized with an acid having the anion X–.

An example of Component (i) is reaction products of oleic acids with diethylenetriamine in a molecular ratio of about 2:1, said reaction product mixture containing N,N"-dioleoyldiethylenetriamine with the formula:

$$R^1—C(O)—NH—CH_2CH_2—NH—CH_2CH_2—NH—C(O)—R^1$$

wherein $R^1$—C(O) is oleoyl group of a commercially available oleic acid derived from a vegetable or animal source, such as Emersol® 223LL or Emersol® 7021, available from Henkel Corporation, and $R^2$ and $R^3$ are divalent ethylene groups.

Another preferred component (i) is a compound of formula:

$$[R^1—C(O)—NR—R^2—NRH—R^2—NR—C(O)—R^1]^+A^-$$

wherein each R, $R^1$, $R^2$, and A– are defined as above.

An example of Compound (i) is a difatty amidoamine based softener having the formula:

$$[R^1—C(O)—NH—CH_2CH_2—NH(CH_2CH_2OH)—CH_2CH_2—NH—C(O)—R^1]^+Cl^-$$

wherein $R^1$—C(O) is oleoyl group.

Still another preferred component (i) is a compound selected from the group consisting of substituted imidazoline compounds having the formula:

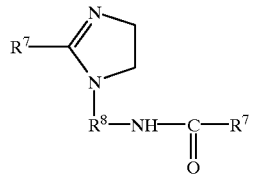

wherein $R^7$ is an acyclic aliphatic $C_{15}$–$C_{21}$ hydrocarbon group and $R^8$ is a divalent $C_1$—$C_3$ alkylene group.

Component (i) materials are commercially available as: Mazamide® 6, sold by Mazer Chemicals, or Ceranine® HC, sold by Sandoz Colors & Chemicals; stearic hydroxyethyl imidazoline sold under the trade names of Alkazine® ST by Alkaril Chemicals, Inc, or Schercozoline® S by Scher Chemicals, Inc.; N,N"-ditallowalkoyldiethylenetriamine; 1-tallowamidoethyl-2-tallowimidazoline (wherein in the preceding structure $R^1$ is an aliphatic $C_{15}$–$C_{17}$ hydrocarbon group and $R^8$ is a divalent ethylene group).

Certain of the Components (i) can also be first dispersed in a Bronsted acid dispersing aid having a pKa value of not greater than about 4. provided that the pH of the final composition is not greater than about 6. Some preferred dispersing aids are hydrochloric acid, phosphoric acid, or methylsulfonic acid.

Both N,N"-ditallowalkoyldiethylenetriamine and 1-tallow(amidoethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N.N"-ditallow alkoyldiethylenetriamine and 1-tallowarnidoethyl-2 -tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

(ii) softener having the formula:

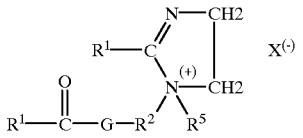

wherein each $R^2$ is a $C_{1-6}$ alkylene group, preferably an ethylene group; and G is an oxygen atom or an —NR— group; and each R, $R^1$, $R^2$ and $R^5$ have the definitions given above and A– has the definitions given above for X.

An example of Compound (ii) is 1-oleylamidoethyl-2-oleylimidazolinium chloride wherein $R^1$ is an acyclic aliphatic $C_{15}$–$C_{17}$ hydrocarbon group, $R^2$ is an ethylene group, G is a NH group, $R^5$ is a methyl group and A– is a chloride anion.

(iii) the reaction product of substantially unsaturated and/or branched chain higher fatty acid with triethanolamine, and subsequently neutralized with an acid having the anion A–.

An example of Compound (iii) is reaction products of oleic acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is oleoyl group of a commercially available oleic acid derived from a vegetable or animal source, such as Emersol® 223LL or Emersol® 7021, available from Henkel Corporation.

(iv) softener having the formula:

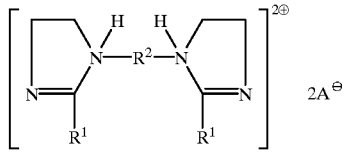

wherein R, $R^1$, $R^2$, and A– are defined as above.

An example of Compound (iv) is the compound having the formula:

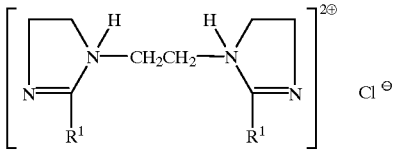

wherein $R^1$ is derived from oleic acid.

Additional fabric softening agents useful herein are described in U.S. Pat. No. 4,661,269 Trinh et al., issued Apr. 28, 1987; U.S. Pat. No. 4,439,335, Burns, issued Mar. 27, 1984; and U.S. Pat. No. 3,861,870, Edwards et al.; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen: U.S. Pat. No. 3,974,076, Wiersema et al.; U.S. Pat. No. 4,237,016, Rudkin, et al; and European Patent Application publication No. 472,178, by Yamamura et al., all of said documents being incorporated herein by reference.

Of course, the term "softening active" can also encompass mixed softening active agents.

Preferred among the classes of softener compounds disclosed herein before are the diester or diamido quaternary ammonium fabric softening active compound (DEQA).

The amount of fabric softening active present in the compositions of the present invention is at least about 1%, preferably from about 10%, more preferably from about 20% to about 80%, more preferably to about 60% by weight, of the composition.

Principal Solvent

The level of principal solvent present in the compositions of the present invention is typically less than about 15%, preferably less than about 12%, more preferably less than about 9%, most preferably less than about 5% by weight. Some embodiments of the present invention comprise no principal solvent.

The principal solvents of the present invention are primarily used to obtain liquid compositions having sufficient clarity and viscosity. Principal solvents must also be selected to minmize solvent odor impact in the composition. For example, isopropyl alcohol is not an effective principal solvent in that it does not serve to produce a composition having suitable viscosity. Isopropanol also fails as a suitable principal solvent because it has a relatively strong odor.

Principal solvents are also selected for their ability to provide stable compositions at low temperatures, preferably compositions comprising suitable principal solvents are clear down to about 4° C. and have the ability to fully recover their clarity if stored as low as about 7° C.

The principal solvents according to the present invention are selected base upon their octanol/water partition coefficient (P). The octanol/water partition coefficient is a measure of the ratio of the concentrations of a particular principal solvent in octanol and water at equilibrium. The partition coefficients are conveniently expressed and reported as their logarithm to the base 10; logP.

The logP of many principal solvent species has been reported; for example, the Ponmona92 database, available from Daylight Chemical Information Systems, Inc.(Daylight CIS), contains many, along with citations to the original literature.

However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ransden, Eds., p. 295, Pergamon Press, 1990, incorporated herein by reference). The fragment approach is based on the chemical structure of each HR species, and takes into account the numbers and types of atoms, the atom connectivity, and chemical bonding. ClogP values are the most reliable and widely used estimates for octanol water partitioning. It will be understood by those skilled in the art that experimental log P values could also be used. Experimental log P values represent a less preferred embodiment of the invention. Where experimental log P values are used, the one hour log P values are preferred. Other methods that can be used to compute ClogP include, e.g., Crippen's fragmentation method as disclosed in *J. Chem. Inf. Comput. Sci.,* 27a,21 (1987); Viswanadhan's fragmentation method as disclosed in *J. Chem. Inf. Comput. Sci.,* 29, 163 (1989); and Broto's method as disclosed in *Eur. J. Med. Chem. -Chim. Theor.,* 19, 71 (1984).

The principal solvents suitable for use in the present invention are selected from those having a ClogP of from about 0.15 to about 1, preferably from about 0.15 to about 0.64, more preferably from about 0.25 to about 0.62, most preferably form about 0.4 to about 0.6. Preferably the principal solvent is at least to some degree an asymmetric molecule, preferably having a melting, or solidification point which allows the principal solvent to be liquid at or near room temperature. Low molecular weight principal solvents may be desirable for some embodiments. More preferred molecules are highly asymmetrical.

However, highly symmetrical molecules inter alia 1,7-heptandiol, 1.4-bis(hydroxymethyl)cyclohexane, and cyclohexane, have a center of symmetry which precludes their use as suitable principal solvents even thought they have CloP values which fall within the desired range.

The most preferred principal solvents can be identified by the appearance of the softener vesicles, as observed via electron microscopy of the compositions that have been diluted to the concentration used in the rinse. These dilute compositions appear to have dispersions of fabric softener that exhibit a more unilamellar appearance than conventional fabric softener compositions.

Preferred principal solvents include mono- alcohols, $C_6$ diols, $C_7$ diols, the isomers of octanediol, derivatives of butanediol, the isomers of trimethylpentanediol, the isomers of ethylmethylpentanediol, the isomers of propylpentanediol, the isomers of dimethylhexanediol, the isomers of ethylhexanediol, the isomers of methylheptanediol, the isomers of octanediol, the isomers of nonanediol, alkyl glyceryl ethers, di(hydroxy alkyl) ethers, aryl glyceryl ethers, the derivatives of alicyclic diols, derivatives of alkoxylated $C_3$–$C_7$ diols, aryl diols, and mixtures thereof as disclosed in W097/03169 "Concentrated, Stable, Preferably Clear, Fabric Softening Composition" incorporated herein by reference.

Nonlimiting examples of preferred principal solvents include 1,2-hexanediol, 2-ethyl-1,3-hexanediol, alcohol ethoxylates of 2-ethyl-1,3-hexanediol, 2,2,4-trimethyl-1,3-pentanediol, alcohol ethoxylates of 2,2,4-trimethyl- 1,3-pentanediol, phenoxyethanol, 1,2-cyclohexanedimethanol, and mixtures thereof.

A preferred embodiment of the present invention is the combination of certain principal solvents. Non-limiting examples of preferred combinations include 2,2,4 -trimethyl-1,3-pentanediol (TMPD) in combination with 1,2-hexanediol, 2-ethyl-1,3-hexanediol, or mixtures thereof. These solvent combinations provide increased phase stability across storage temperatures and fully recoverable compositions from below the water freezing point.

For the preceding ester fabric softening agents, the pH of the compositions herein is an important parameter of the present invention. Indeed, it influences the stability of the quaternary ammonium or amine precursors compounds, especially in prolonged storage conditions.

The pH, as defined in the present context, is measured in the neat compositions at 20° C. While these compositions are operable at pH of less than about 6.0, for optimum hydrolytic stability of these compositions, the neat pH, measured in the above-mentioned conditions, must preferably be in the range of from about 2.0 to about 5, preferably in the range of 2.5 to 4.5, preferably about 2.5 to about 3.5. The pH of these compositions herein can be regulated by the addition of a Bronsted acid. Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Adjunct Ingredients

Stabilizers

Stabilizers are highly desirable in finished compositions. The term "stabilizer," as used herein, includes antioxidants and reductive agents. These agents are present at a level of from 0%, preferably from about 0.001%, more preferably from about 0.01%, even more preferably from about 0.035% to about 2.0%, preferably to about 0.2%, more preferably to about 0. 1% for antioxidants, and more preferably from about 0.01% to about 0.2% for reductive agents, in either the formed softener active or in the final composition. For the premix, the levels are adjusted, depending on the concentrations of the softener active in the premix and the finished composition. These assure good odor stability under long term storage conditions. Antioxidants and reductive agent stabilizers are especially critical for unscented or low scent products (no or low perfume).

Examples of antioxidants that can be added to the dispersion compositions include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products. Inc., under the trade name Tenox®-6; butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyanisole, Eastman Chemical Products, Inc., as BHA: long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox®3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1,1-diphosphonic acid (etidronic acid), and Tiron®, available from Kodak with a chemical name of 4,5-dihydroxy-m-benzene-sulfonic acid/sodium salt and DTPA.RTM., available from Aldrich with a chemical name of diethylenetriaminepentaacetic acid. For further examples of suitable stabilizers see U.S. Pat. No. 5,574,179 Wahl et al., issued February 28, 1995 incorporated herein by reference. Low molecular weiaht water soluble solvents Low molecular weight water soluble solvents can also be used at levels of from 0% to 12%, preferably from 1% to 10%, more preferably from 2% to 8% by weight. The water soluble solvents cannot provide a clear product at the same low levels of the principal solvents described hereinbefore but can provide clear product when the principal solvent is not sufficient to provide completely clear product. The presence of these water soluble solvents is therefore highly desirable. Such solvents include: ethanol, isopropanol; propylene glycol; hexylene glycol. 1,2-propanediol, 1,3-propanediol; propylene carbonate; 1.4 cyclohexanedimethanol; etc. but do not include any of the principal solvents. These water soluble solvents have a greater affinity for water in the presence of hydrophobic materials like the softener compound than the principal solvents.

Among the above described co-solvent to be used in combination with the principal solvent, hexylene glycol and/or ethanol are preferred co-solvents. Due to processing conditions, some of the principal solvent which comprises the compositions of the present invention enter into the formulation by way of the softener active, for example, ethanol, hexylene glycol, and mixtures thereof can be used in preparing the preferred softener actives of the present invention and, therefore, are part of the DEQA raw material system.

Chelating Agents

The compositions formed via the present invention may include one or more chelating agents such as copper and/or nickel chelating agents ("chelators"), for example, diethylenetriaminepentaacetic acid (DTPA) or ethylenediamine-N, N'-disuccinnic acid (EDDS) which can be added during the formation of the fabric softening active or the fabric softening composition. The chelating agent may be present in the composition in the range of from about 0.001% to about 10% by weight of the composition. More preferably the chelant is present in the range of from about 0.0 1% to about 5% and most preferably in the range of from about 0.01% to about 3% by weight of the composition.

Such water-soluble chelating agents can be selected from the group consisting of amino carboxylates, amino phosphonates, polyfunctionally-substituted aromatic chelating agents and mixtures thereof, all as hereinafter defined and all preferably in their acidic form. Amino carboxylates useful as chelating agents herein include ethylenediaminetetraacetic acid (EDTA), N-hydroxyethylethylenediaminetriacetates, nitrilotriacetates NTA), ethylenediamine tetraproprionates, ethylenediamine-N,N'-diglutamates, 2-hyroxypropylenediamine-N,N'-disuccinates, triethylenetetraatninehexacetates, diethylenetriaminepentaacetates (DTPA) and ethanoldiglycines, including their water-soluble salts such as the alkali metal, ammonium, and substituted ammonium salts thereof and mixtures thereof.

Amino phosphonates are also suitable for use as chelating agents in the compositions of the invention when at least low levels of total phosphorus are permitted in rinse-added fabric softener compositions, and include ethylenediaminetetrakis (methylenephosphonates), diethylenctriamine-N,N,N',N", N"-pentakis(methane phosphonate) (DTMP) and 1-hydroxyethane-1,1-diphosphonate (HEDP). Preferably, these amino phosphonates to not contain alkyl or alkenyl groups with more than about 6 carbon atoms.

As can be seen from the foregoing, a wide variety of chelators may be added to the compositions. Indeed, simple polycarboxylates such as citrate, oxydisuccinate, and the like, may also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 10%, more preferably from about 0.75% to about 5%, by weight of the compositions herein.

For preferred chelants for use in obtaining enhanced color fidelity in the compositions of the present invention see U.S. Pat. No. 5,686,376 Rusche et al., issued Nov. 11, 1997 included herein by reference in its entirety.

Cationic Charge Boosters

Cationic charge boosters may be added to the rinse-added fabric softening compositions of the present invention. Typically, ethanol is used to prepare many of the below listed ingredients and is therefore a source of solvent into the final product formulation. The formulator is not limited to ethanol, but instead can add other solvents inter alia hexyleneglycol to aid in formulation of the final composition. This is especially true in clear, translucent, isotropic compositions.

The preferred cationic charge boosters of the present invention are described herein below.

i) Quaternary Ammonium Compounds

A preferred composition of the present invention comprises at least about 0.2%. preferably from about 0.2% to about 10%, more preferably from about 0.2% to about 5% by weight, of a cationic charge booster having the formula:

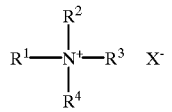

wherein $R^1$, $R^2$, $R^3$, and $R^4$ are each independently $C_1$–$C_{22}$ alkyl, $C_3$–$C_{22}$ alkenyl, $R^5$-Q-(C H )m-. wherein $R^5$ is $C_1$–$C_{22}$ alkyl, and mixtures thereof, m is from 1 to about 6; X is an anion.

Preferably $R^1$ is $C_6$–$C_{22}$ alkyl, $C_6$–$C_{22}$ alkenyl, and mixtures thereof, more preferably $C_{11}$–$C_{18}$ alkyl $C_{11}$–$C_{18}$ alkenyl, and mixtures thereof; $R^2$, $R^3$, and $R^4$ are each preferably $C_1$–$C_4$ alkyl, more preferably each $R^2$, $R^3$, and $R^4$ are methyl.

The formulator may similarly choose $R^1$ to be a $R^5$-Q-$(CH_2)$m- moiety wherein $R^5$ is an alkyl or alkenyl moiety having from 1 to 22 carbon atoms, preferably the alkyl or alkenyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5$-Q-($CH_2$)m-moiety has the formula:

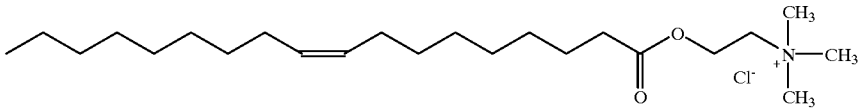

wherein $R^5$-Q- is an oleoyl units and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

ii) Polyvinyl Amines

A preferred composition according to the present invention contains at least about 0.2%, preferably from about 0.2% to about 5%, more preferably from about 0.2% to about 2% by weight, of one or more polyvinyl amines having the formula

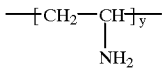

wherein y is from about 3 to about 10,000, preferably from about 10 to about 5,000, more preferably from about 20 to about 500. Polyvinyl amines suitable for use in the present invention are available from BASF.

Optionally, one or more of the polyvinyl amine backbone —NH unit hydrogens can be substituted by an alkyleneoxy unit having the formula:

$$-(R^1O)_xR^2$$

wherein $R^1$ is $C_2$–$C_4$ alkylene. $R^2$ is hydrogen, $C_1$–$C_4$ alkyl, and mixtures thereof; x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

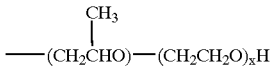

wherein x has the value of from 1 to about 50. Substitutions such as the above are represented by the abbreviated formula PO-$EO_x$-. However, more than one propyleneoxy unit can be incorporated into the alkyleneoxy substituent.

Polyvinyl amines are especially preferred for use as cationic charge booster in liquid fabric softening compositions since the greater number of amine moieties per unit weight provides substantial charge density. In addition, the cationic charge is generated in situ and the level of cationic charge can be adjusted by the formulator.

iii) Polyalkyleneimines

A preferred composition of the present invention comprises at least about 0.2%. preferably from about 0.2% to about 10%, more preferably from about 0.2% to about 5% by weight, of a polyalkyleneimine charge booster having the formula:

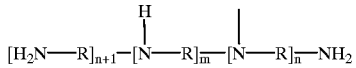

wherein the value of m is from 2 to about 700 and the value of n is from 0 to about 350. Preferably the compounds of the present invention comprise polyamines having a ratio of m:n that is at least 1:1 but may include linear polymers (n equal to 0) as well as a range as high as 10:1. preferably the ratio is 2:1. When the ratio of m:n is 2:1, the ratio of primary-:secondary:tertary amine moieties, that is the ratio of —$RNH_2$, —RNH, and —RN moieties, is 1:2:1.

R units are $C_2$–$C_8$ alkylene, $C_3$–$C_8$ alkyl substituted alkylene, and mixtures thereof, preferably ethylene, 1,2-propylene, 1,3-propylene, and mixtures thereof, more preferably ethylene. R units serve to connect the amine nitrogens of the backbone.

Optionally, one or more of the polyvinyl amine backbone —$NH_2$ unit hydrogens can be substituted by an alkyleneoxy unit having the formula:

$$-(R^1O)_xR^2$$

wherein $R_1$ is $C_2$–$C_4$ alkylene, $R^2$ is hydrogen, $C_1$–$C_4$ alkyl, and mixtures thereof; x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

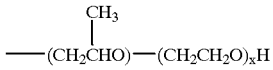

wherein x has the value of from 1 to about 50. Substitutions such as the above are represented by the abbreviated formula PO-$EO_x$-. However, more than one propyleneoxy unit can be incorporated into the alkyleneoxy substituent.

The preferred polyamine cationic charge boosters suitable for use in rinse-added fabric softener compositions comprise backbones wherein less than 50% of the R groups comprise more than 3 carbon atoms. The use of two and three carbon spacers as R moieties between nitrogen atoms in the backbone is advantageous for controlling the charge booster properties of the molecules. More preferred embodiments of the present invention comprise less than 25% moieties having more than 3 carbon atoms. Yet more preferred backbones comprise less than 10% moieties having more than 3 carbon atoms. Most preferred backbones comprise 100% ethylene moieties.

The cationic charge boosting polyamines of the present invention comprise homogeneous or non-homogeneous polyamine backbones, preferably homogeneous backbones.

For the purpose of the present invention the term "homogeneous polyamine backbone" is defined as a polyamine backbone having R units that are the same (i.e., all ethylene). However, this sameness definition does not exclude polyamines that comprise other extraneous units comprising the polymer backbone that are present due to an artifact of the chosen method of chemical synthesis. For example it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention.

For the purposes of the present invention the term "non-homogeneous polymer backbone" refers to polyamine backbones that are a composite of one or more alkylene or substituted alkylene moieties, for example, ethylene and 1,2-propylene units taken together as R units However, not all of the suitable charge booster agents belonging to this category of polyamine comprise the above described polyamines. Other polyamines that comprise the backbone of the compounds of the present invention are generally polyalkyleneamines (PAA's), polyalkyleneimines (PAI's), preferably polyethyleneamine (PEA's), or polyethyleneimines (PEI's). A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and tetraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372, Dickinson, issued May 14, 1957, which describes the preparation of PEA's.

The PEI's which comprise the preferred backbones of the charge boosters of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing PEI's are disclosed in U.S. Pat. No. 2,182,306, Ulrich et all., issued Dec. 5, 1939. U.S. Pat. No. 3,033,746, Mayle et al., issued May 8, 1962, U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson. issued May 21, 1951 (all herein incorporated by reference). In addition to the linear and branched PEI's, the present invention also includes the cyclic amines that are typically formed as artifacts of synthesis. The presence of these materials may be increased or decreased depending on the conditions chosen by the formulator.

iv) Poly-Quaternary Ammonium Compounds

A preferred composition of the present invention comprises at least about 0.2%, preferably from about 0.2% to about 10%. more preferably from about 0.2% to about 5% by weight, of a cationic charge booster having the formula:

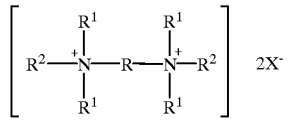

wherein R is substituted or unsubstituted $C_2$–$C_{12}$ alkylene, substituted or unsubstituted $C_2$–$C_{12}$ hydroxyalkylene, each $R^1$ is independently $C_1$–$C_4$ alkyl each $R^2$ is independently $C_1$–$C_{22}$ alkyl, $C_3$–$C_{22}$ alkenyl. $R^5$-Q-$(CH_2)$m-, wherein $R^5$ is $C_1$–$C_{22}$ alkyl, $C_3$–$C_{22}$ alkenyl, and mixtures thereof; m is from 1 to about 6; Q is a carbonyl unit as defined hereinabove; and mixtures thereof. X is an anion.

Preferably R is ethylene, $R^1$ is methyl or ethyl, more preferably methyl; at least one $R^2$ is preferably $C_1$–$C_4$ alkyl, more preferably methyl. Preferably at least one $R^2$ is $C_{11}$–$C_{22}$ alkyl, $C_{11}$–$C_{22}$ alkenyl, and mixtures thereof.

The formulator may similarly choose $R^2$ to be a $R^5$-Q-$(CH_2)_m$- moiety wherein $R^5$ is an alkyl moiety having from 1 to 22 carbon atoms, preferably the alkyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5$-Q-$(CH_2)_m$-moiety has the formula:

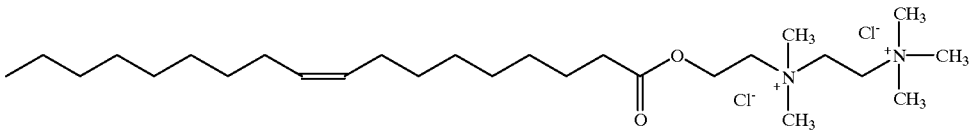

wherein $R^1$ is methyl, one $R^2$ units is methyl and the other $R^2$ unit is $R^5$-Q-$(CH_2)_m$-wherein $R^5$-Q- is an oleoyl unit and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

Dispersibility Aids

Relatively concentrated compositions containing both saturated and unsaturated diester quaternary ammonium compounds can be prepared that are stable without the addition of concentration aids. However, the compositions of the present invention may require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of (1) single long chain alkyl cationic surfactants, (2) nonionic surfactants. (3) amine oxides; (4) fatty acids; and (5) mixtures thereof. These aids are described in P&G Copending Application Ser. No. 08/461,207, filed Jun. 5, 1995, Wahl et al., specifically on page 14. line 12 to page 20, line 12, which is herein incorporated by reference.

When said dispersibility aids are present , the total level is from 2% to 25%, preferably from 3% to 17%, more preferably from 4% to 15%, and even more preferably from 5% to 13% by weight of the composition. These materials can either be added as part of the active softener raw material, e.g., the mono-long chain alkyl cationic surfactant and/or the fatty acid which are reactants used to form the fabric softener active as discussed hereinbefore, or added as a separate component. The total level of dispersibility aid includes any amount that may be present as part of the softener active.

Soil Release Agents

Particular to the embodiments of the rinse-added fabric softeners according to the present invention, certain soil release agents provide not only the below described soil release properties but are added for their suitability in maintaining proper viscosity, especially in the dispersed phase, non-isotropic compositions.

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the rinsing cycle and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10.0%, by weight, of the detergent compositions herein, typically from about 0.1 % to about 5%, preferably from about 0.2% to about 3.0%.

The following, all included herein by reference, describe soil release polymers suitable for use in the present invention. U.S. Pat. No. 3,959,230 Hays, issued May 25, 1976; U.S. Pat. No. 3,893,929 Basadur, issued Jul. 8, 1975; U.S. Pat. No. 4,000,093, Nicol, et al., issued Dec. 28, 1976; U.S. Pat. No. 4,702,857 Gosselink, issued Oct. 27, 1987; U.S. Pat. No. 4,968,451, Scheibel et al., issued November 6; U.S. Pat. No. 4,702,857. Gosselink, issued Oct. 27, 1987; U.S. Pat. No. 4,711,730, Gosselink el al., issued Dec. 8, 1987; U.S. Pat. No. 4,721,580, Gosselink, issued Jan. 26, 1988; U.S. Pat. No. 4,877,896, Maldonado et al., issued Oct. 31. 1989; U.S. Pat. No. 4,956,447, Gosselink et al., issued Sep. 11, 1990; U.S. Pat. No. 5,415,807 Gosselink et al., issued May 16, 1995; European Patent Application 0 219 048, published Apr. 22, 1987 by Kud, et al.

Further suitable soil release agents are described in U.S. Pat. No. 4,201,824, Violland et al.; U.S. Pat. No. 4,240,918 Lagasse et al.; U.S. Pat. No. 4,525,524 Tung et al.; U.S. Pat. No. 4,579,681, Ruppert et al.; U.S. Pat. No. 4,240,918; U.S. Pat. No. 4,787,989; U.S. Pat. No. 4,525,524; EP 279,134 A. 1988, to Rhone-Poulenc Chemie; EP 457,205 A to BASF (1991); and DE 2,335,044 to Unilever N. V., 1974 all incorporated herein by reference.

Commercially available soil release agents include the METOLOSE SM 100, METOLOSE SM200 manufactured by Shin-etsu Kagaku Kogyo K.K., SOKALAN type of material, e.g., SOKALAN HP-22. available from BASF (Germany). ZELCON 5126 from Dupont) and MILEASE T (from ICI).

A preferred soil release agent is described in U.S. Pat. No. 4,702,857 Gosselink, issued Oct. 27, 1987.

Enzymes

The compositions and processes herein can optionally comprise one or more enzymes such as lipases, proteases, cellulase, amylases and peroxidases. A preferred enzyme for use herein is a cellulase enzyme. Indeed, this type of enzyme will further provide a color care benefit to the treated fabric. Cellulases usable herein include both bacterial and fungal types, preferably having a pH optimum between 5 and 9.5. U.S. Pat. No. 4,435,307 discloses suitable fungal cellulases from Humicola insolens or Humicola strain DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2,075,028; GB-A-2, 095,275 and DE-OS-2,247, 832. CAREZYME® and CELLUZYME® (Novo) are especially useful. Other suitable cellulases are also disclosed in WO 91/17243 to Novo. WO 96/34092. WO 96/34945 and EP-A-0,739,982. In practical terms for current commercial preparations, typical amounts are up to 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. In the particular cases where activity of the enzyme preparation can be defined otherwise such as with cellulases, corresponding activity units are preferred (e.g. CEVU or cellulase Equivalent Viscosity Units). For instance, the compositions of the present invention can contain cellulase enzymes at a level equivalent to an activity from 0.5 to 1000 CEVU/gram of composition. Cellulase enzyme preparations used for the purpose of formulating the compositions of this invention typically have an activity comprised between 1,000 and 10,000 CEVU/gram in liquid form, around 1,000 CEVU/gram in solid form.

Electrolyte

The compositions of the present invention further optionally comprise electrolytes for control of phase stability, viscosity, and/or clarity. The electrolytes of the present invention are typically water soluble, ionizable salts. A wide variety of ionizable salts can be used. Examples of suitable salts are the halides of the Group IA and IIA metals of the Periodic Table of the elements, e.g., calcium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 10,000 parts per million (ppm). preferably from about 20 to about 5,000 ppm, of the composition.

Alkylene polyammonium salts can be incorporated into the composition to give viscosity control in addition to or in place of the water-soluble, ionizable salts above, In addition, these agents can act as scavengers, forming ion pairs with anionic detergent carried over from the main wash, in the rinse, and on the fabrics, and can improve softness performance. These agents can stabilized the viscosity over a broader range of temperature, especially at low temperatures, compared to the inorganic electrolytes. Specific examples of alkylene polyammonium salts include L-lysine, monohydrochloride and 1,5-diammonium 2-methyl pentane dihydrochloride.

Perfume

The present invention can contain any softener compatible perfume. Suitable perfumes are disclosed in U.S. Pat. No. 5,500,138, said patent being incorporated herein by reference.

As used herein, perfume includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

Examples of perfume ingredients useful in the perfumes of the present invention compositions include, but are not limited to, hexyl cinnamic aldehyde; amyl cinnamic aldehyde; amyl salicylate; hexyl salicylate; terpineol; 3,7-dimethyl-cis-2,6-octadien- 1-ol; 2,6-dimethyl-2-octanol; 2,6-dimethyl-7-octen-2-ol; 3,7-dimethyl-3-octanol; 3,7-dimethyl-trans-2,6-octadien- 1-ol; 3 ,7-dimethyl-6-octen-1-ol; 3,7-dimethyl-1-octanol; 2-methyl-3-(para-tert-butylphenyl)-propionaldehyde; 4-(4-hydroxy-4-methylpentyl)-3-cyclohexene-1-carboxaldehyde; tricyclodecenyl propionate; tricyclodecenyl acetate; anisaldehyde; 2-methyi-2-(para-iso-propylphenyl)-propionaldehyde; ethyl-3-methyl-3-phenyl glycidate; 4-(para-hydroxyphenyl)-butan-2-one; 1-(2,6,6-trimethyl-2-cyclohexen-1-yl)-2-buten-1-one; para-methoxyacetophenone; para-methoxy-alpha-phenylpropene; methyl-2-n-hexyl-3-oxo-cyclopentane carboxylate; undecalactone gamma.

Additional examples of fragrance materials include, but are not limited to, orange oil; lemon oil; grapefruit oil; bergamot oil; clove oil; dodecalactone gamma; methyl-2-(2-pentyl-3-oxo-cyclopentyl) acetate; beta-naphthol methyl-ether; methyl-beta-naphthylketone; coumarin; decylaldehyde; benzaldehyde; 4-tert-butylcyclohexyl acetate; alpha, alpha-dimethylphenethyl acetate; methylphenyicarbinyl acetate; Schiff's base of 4-(4-hydroxy-4-methylpentyl)-3-cyclohexene-1-carboxaldehyde and methyl anthranilate; cyclic ethyleneglycol diester of tridecandioic acid; 3,7-dimethyl-2,6-octadiene-1-nitrile; ionone gamma methyl; ionone alpha; ionone beta; petitgrain; methyl cedrylone; 7-acetyl-1,2,3,4,5,6,7,8-octahydro- 1,1,6,7-tetramethyl-naphthalene; ionone methyl; methyl-1,6,10-trimethyl-2,5,9-cyclododecatrien- 1-yl ketone; 7-acetyl- 1,1,3,4,4,6-hexamethyl tetralin; 4-acetyl-6-tert-butyl- 1,1-dimethyl indane; benzophenone; 6-acetyl- 1,1,2,3 ,3,5-hexamethyl indane; 5-acetyl-3-isopropyl-1,1,2,6-tetramethyl indane; 1-dodecanal; 7-hydroxy-3,7-dimethyl octanal; 10-undecen-1-al; iso-hexenyl cyclohexyl carboxaldehyde; formyl tricyclodecan; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; ambroxane; dodecahydro-3a,6,6,9a-tetramethylnaphtho-[2,1b]furan; cedrol; 5-(2,2,3-trimethylcyclopent-3-enyl)-3-methylpentan-2-ol; 2-ethyl-4-(2,2 ,3-trimethyl-3-cyclopenten-1-yl)-2-buten-1-ol; caryophyllene alcohol; cedryl acetate; para-tert-butylcyclohexyl acetate; patchouli; olibanum resinoid; labdanum; vetivert; copaiba balsam; fir balsam; and condensation products of: hydroxycitronellal and methyl anthranilate; hydroxycitronellal and indol; phenyl acetaldehyde and indol; 4-(4-hydroxy-4-methyl pentyl)-3-cyclohexene- 1-carboxaldehyde and methyl anthranilate. More examples of perfume components are geraniol; geranyl acetate; linalool; linalyl acetate; tetrahydrolinalool; citronellol; citronellyl acetate; dihydromyrcenol; dihydromyrcenyl acetate; tetrahydromyrcenol; terpinyl acetate; nopol; nopyl acetate; 2-phenylethanol; 2-phenylethyl acetate; benzyl alcohol; benzyl acetate; benzyl salicylate; benzyl benzoate; styrallyl acetate; dimethylbenzylcarbinol; trichloromethylphenylcarbinyl methylphenylcarbinyl acetate; isononyl acetate; vetiveryl acetate; vetiverol; 2-methyl-3-(p-tert-butylphenyl)-propanal; 2-methyl-3-(p-isopropylphenyl)-propanal; 3-(p-tert-butylphenyl)-propanal; 4-(4-methyl-3-pentenyl)-3-cyclohexenecarbaldehyde; 4-acetoxy-3-pentyltetrahydropyran; methyl dihydrojasmonate; 2-n-heptylcyclopentanone; 3-methyl-2-pentyl-cyclopentanone; n-decanal; n-dodecanal; 9-decenol-1; phenoxyethyl isobutyrate; phenylacetaldehyde dimethylacetal; phenylacetaldehyde diethylacetal; geranonitrile; citronellonitrile; cedryl acetal; 3-isocamphylcyclohexanol; cedryl methylether; isolongifolanone; aubepine nitrile; aubepine; heliotropine; eugenol; vanillin; diphenyl oxide; hydroxycitronellal ionones; methyl ionones; isomethyl ionomes; irones; cis-3-hexenol and esters thereof; indane musk fragrances; tetralin musk fragrances; isochroman musk fragrances; macrocyclic ketones; macrolactone musk fragrances; ethylene brassylate.

The perfumes useful in the present invention compositions are substantially free of halogenated materials and nitromusks. Suitable solvents, diluents or carriers for perfumes ingredients mentioned above are for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution. Perfume can be present at a level of from 0% to 10%, preferably from 0.1% to 5%, and more preferably from 0.2% to 3%, by weight of the finished composition. Fabric softener compositions of the present invention provide improved fabric perfume deposition.

Perfume ingredients may also be suitably added as releasable fragrances, for example, as pro-perfumes or pro-fragrances as described in U.S. Pat. No. 5,652,205 Hartman et al., issued Jul. 29, 1997 incorporated herein by reference.

Optional Ingredients

Other optional ingredients useful in compositions of the present invention include, but are not limited to, dye transfer inhibiting agents, scum dispersants, suds suppressors, optical brighteners or other brightening or whitening agents, dye fixing agents, light fading protection agents, oxygen bleach protection agents, fabric softening clay, anti-static agents, other active ingredients, carriers, hydrotropes, processing aids, dyes or pigments, bactericides, colorants, perfumes, preservatives, opacifiers, anti-shrinkage agents, anti-wrinkle agents, fabric crisping agents, spotting agents, germicides, fungicides, anti-corrosion agents, and the like.

The following are non-limiting examples of rinse-added fabric softener compositions according to the present invention. These compositions provide surprisingly good fabric softening as compared to similar compositions prepared in the conventional manner or to those comprising higher levels of principal solvent without the polyoxyalkylene alkylamide surface active agents of the present invention.

TABLE I

| Ingredients | weight % | | | | |
|---|---|---|---|---|---|
| | 1 | 2 | 3 | 4 | 5 |
| Softener Active[1] | 28.0 | 30.0 | 30.0 | 30.0 | 30.0 |
| Ethanol | 2.4 | 2.3 | 2.6 | 2.6 | 2.6 |
| Hexyleneglycol | 2.3 | 2.7 | 2.3 | 2.3 | 2.3 |
| 2,2,4-Trimethyl-1,3-pentanediol | 4.0 | — | 5.0 | 9.0 | 9.0 |
| 2-Ethyl-1,3-hexandiol | 4.0 | — | — | — | — |
| Polyoxyalkylene alkylamide[2] | 1.5 | 1.5 | 1.5 | 1.5 | — |
| Polyoxyalkylene alkylamide[3] | — | — | — | — | 1.5 |
| $CaCl_2$ | 0.05 | 0.5 | 0.125 | 0.125 | 0.125 |
| Perfume | 2.5 | 1.0 | 2.5 | 2.5 | 2.5 |
| Demineralized water | balance | balance | balance | balance | balance |

[1]N,N-di-(canolyl-oxy-ethyl)-N-methyl-N-(2-hydroxyethyl)ammonium methyl sulfate.
[2]PEG-6 cocamide, (Rewopal C6 ex Witco Chemical).
[3]PEG-5 lauramide (Amidox L-5, ex Stepan Chemical).

TABLE II

| Ingredients | weight % | | | | |
|---|---|---|---|---|---|
| | 6 | 7 | 8 | 9 | 10 |
| Softener Active[1] | 30.0 | 30.0 | 35.0 | 23.4 | 36.0 |
| Ethanol | 2.6 | 3.4 | 2.5 | 2.0 | 3.1 |
| Hexyleneglycol | 2.3 | 2.3 | 2.5 | — | 6.2 |
| 2,2,4-Trimethyl-1,3-pentanediol | 9.0 | 9.0 | 4.0 | — | — |
| 2-Ethyl-1,3-hexandiol | — | — | 4.0 | — | — |
| Polyoxyalkylene alkylamide[2] | — | 1.5 | 3.0 | 2.1 | 1.8 |
| Polyoxyalkylene alkylamide[3] | 1.5 | — | — | — | — |
| Monocanola trimethylammonium chloride[4] | — | 1.5 | — | — | — |
| $CaCl_2$ | 0.125 | 0.125 | 0.125 | 0.33 | 0.125 |
| Perfume | 2.5 | 2.5 | 2.5 | 2.1 | 1.2 |
| Demineralized water | balance | balance | balance | balance | balance |

[1]N,N-di-(canolyl-oxy-ethyl)-N-methyl-N-(2-hydroxyethyl)ammonium methyl sulfate.
[2]PEG-6 cocamide, (Rewopal C6 ex Witco Chemical).
[3]PEG-7 oleamide (Ethomid 0/17, ex Akzo Chemical).
[4]Adogen 417, ex Witco Chemical.

TABLE III

| Ingredients | weight % | |
|---|---|---|
| | 11 | 12 |
| Softener Active[1] | 28.0 | 23.0 |
| Ethanol | 2.4 | 2.4 |
| Hexyleneglycol | 2.3 | 2.3 |
| 2,2,4-Trimethyl-1,3-pentanediol | — | — |
| 2-Ethyl-1,3-hexandiol | 8.0 | 8.0 |
| Polyoxyalkylene alkylamide[2] | — | 1.5 |
| Polyoxyalkylene alkylamide[3] | 1.5 | — |
| $CaCl_2$ | 0.125 | 0.125 |
| Perfume | 2.5 | 2.5 |
| Demineralized water | balance | balance |

[1]N,N-di-(canolyl-oxy-ethyl)-N-methyl-N-(2-hydroxyethyl)ammonium methyl sulfate.
[2]PEG-6 cocamide, (Rewopal C6 ex Witco Chemical).
[3]PEG-7 oleamide (Ethomid 0/17, ex Akzo Chemical).

What is claimed is:

1. A rinse-added fabric softening composition comprising:

a) from about 1% to about 80% by weight, of a fabric softening active;

b) from 2% to about 15% by weight, of a principal solvent, said principal solvent having a ClogP of from about 0.15 to about 1, and said principal solvent is selected from the group consisting of $C_6$ diols, $C_7$ diols, the isomers of octanediol, derivatives of butanediol, the isomers of trimethylpentanediol, the isomers of ethylmethylpentanediol, the isomers of propylpentanediol, the isomers of dimethylhexanediol, the isomers of ethylhexanediol, the isomers of methylheptanediol, the isomers of octanediol, the isomers of nonanediol, alkyl glyceryl ethers, di(hydroxy alkyl) ethers, aryl glyceryl ethers, the derivatives of alicyclic diols, derivatives of alkoxylated $C_3$–$C_7$ diols, aryl diols, and mixtures thereof;

c) from about 0.5% to about 10% by weight, of a polyoxyalkylene alkyl amide surface active agent; and d) the balance carriers and adjunct ingredients.

2. A composition according to claim 1 wherein said polyoxyalkylene alkylamide surface active agent has the formula:

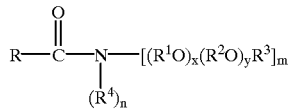

wherein R is $C_7$–$C_{21}$ linear alkyl, $C_7$–$C_{21}$ branched alkyl, $C_7$–$C_{21}$ linear alkenyl, $C_7$–$C_{21}$ branched alkenyl, and mixtures thereof; $R^1$ is ethylene; $R^2$ is $C_3$–$C_4$ linear alkyl, $C_3$–$C_4$ branched alkyl, and mixtures thereof; $R^3$ is hydrogen, $C_1$–$C_4$ linear alkyl, $C_3$–$C_4$ branched alkyl, and mixtures thereof; $R^4$ is hydrogen, $C_1$–$C_4$ linear alkyl, $C_3$–$C_4$ branched alkyl, and mixtures thereof; m is 1 or 2, n is 0 or 1, provided that when m is 1 n is 1 and when m is 2 n is 0; x is from 0 to about 50; y is from 0 to about 10.

3. A composition according to claim 2 wherein for said polyoxyalkylene alkylamide surface active agent x is from about 3 to about 25 and y is 0.

4. A composition according to claim 3 wherein x is from about 3 to about 10.

5. A composition according to claim 4 wherein $R^3$ and $R^4$ are each hydrogen, m is 1 and n is 1.

6. A composition according to claim 3 wherein said polyoxyalkylene alkylamide surface active agent comprises an acyl unit having the formula:

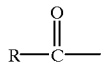

wherein said acyl unit is derived from a source of triglyceride selected from the group consisting of tallow, hard tallow, lard, coconut oil, partially hydrogenated coconut oil, canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, synthetic triglyceride feedstocks and mixtures thereof.

7. A composition according to claim 6 wherein said source of triglyceride is tallow, hard tallow, coconut oil, partially hydrogenated coconut, canola oil, hydrogenated canola oil, synthetic triglyceride feedstocks, and mixtures thereof.

8. A composition according to claim 1 wherein said fabric softening active comprises a quaternary ammonium compound having the formula:

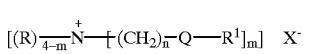

or amine precursor having the formula:

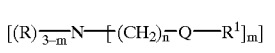

wherein each R is independently $C_1$–$C_6$ alkyl, $C_1$–$C_6$ hydroxyalkyl, benzyl, and mixtures thereof; $R^1$ is $C_{11}$–$C_{22}$ alkyl, $C_{11}$–$C_{22}$ alkenyl, and mixtures thereof; Q is a carbonyl moiety having the formula:

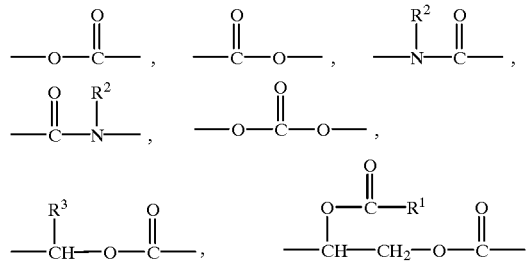

wherein $R^2$ is hydrogen, $C_1$–$C_4$ alkyl, $C_1$–$C_4$ hydroxyalkyl, and mixtures thereof; $R^3$ is hydrogen, $C_1$–$C_4$ alkyl, and mixtures thereof; X is a softener compatible anion; m is from 1 to 3; n is from 1 to 4.

9. A composition according to claim 8 wherein Q has the formula:

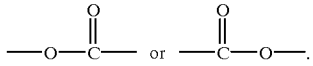

10. A composition according to claim 8 wherein R is methyl, hydroxyethyl, and mixtures thereof.

11. A composition according to claim 8 wherein n is equal to 2.

12. A composition according to claim 8 wherein said quaternary ammonium fabric softening active comprises an acyl moiety having the formula:

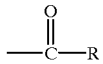

wherein said acyl unit is derived from a source of triglyceride selected from the group consisting of tallow, hard tallow, lard, canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, synthetic triglyceride feedstocks, and mixtures thereof.

13. A composition according to claim 12 wherein said source of triglyceride is canola oil, partially hydrogenated canola oil, and mixtures thereof.

14. A composition according to claim 1 comprising less than or equal to about 12% by weight, of said principal solvent.

15. A composition according to claim 14 comprising less than or equal to about 9% by weight, of said principal solvent.

16. A composition according to claim 15 comprising less than or equal to about 5% by weight, of said principal solvent.

17. A composition according to claim 1 comprising 2,2,4-trimethyl-1,3-pentandiol, 1,2-hexandiol, 2-ethyl-1,3-hexanediol, phenoxyethanol, butyl carbitol, and mixtures thereof.

18. A composition according to claim 1 wherein said composition has a pH of from about 2 to about 5.

19. A composition according to claim 1 further comprising adjunct ingredients selected from the group consisting of nonionic fabric softening agents, concentration aid, soil release agent, perfume, preservatives, stabilizers, colorants, optical brighteners, opacifiers, fabric conditioning agents, anti-shrinkage agents, anti-wrinkle agents, fabric crisping agents, spotting agents, germicides, fungicides, anti-corrosion agents, antifoam agents, and mixtures thereof.

20. A composition according to claim 1 wherein the fabric softener active is selected from the group consisting of N,N-di(tallowyl-oxy-ethyl)-N,N-dimethyl ammonium chloride; N,N-di(canolyl-oxy-ethyl)-N,N-dimethyl ammonium chloride; N,N-di(tallowyl-oxy-ethyl)-N-methyl, N-(2-hydroxyethyl) ammonium methyl sulfate; N,N-di(canolyl-oxy-ethyl)-N-methyl, N-(2-hydroxyethyl) ammonium methyl sulfate; and mixtures thereof.

21. A rinse-added fabric softening composition comprising:

a) at least an effective amount of N,N-di(tallowyl-oxyethyl)-N-methyl, N-(2-hydroxyethyl) ammonium methyl sulfate;

b) from about 0.5% to about 10% by weight, of a polyoxyalkylene alkylamide surface active agent having the formula:

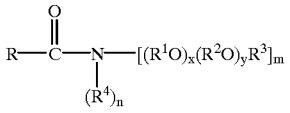

wherein R is $C_7$–$C_{21}$ linear alkyl, $C_7$–$C_{21}$ branched alkyl, $C_7$–$C_{21}$ linear alkenyl, $C_7$–$C_{21}$ branched alkenyl, and mixtures thereof; $R^1$ is ethylene, $R^3$ is hydrogen, $R^4$ is hydrogen, n is 1, m is 1, x is from about 4 to about 9, and y is 0:

c) optionally from 2% to about 15% by weight, of a principal solvent, said principal solvent having a ClogP of from about 0.15 to about 1; and d) the balance carriers and adjunct ingredients.

22. A process for making a low principal solvent rinse-added fabric softener composition comprising the step of adding a nonionic surfactant having the formula:

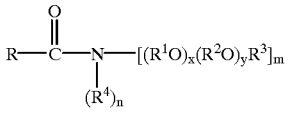

wherein R is $C_7$–$C_{21}$ linear alkyl, $C_7$–$C_{21}$ branched alkyl, $C_7$–$C_{21}$ linear alkenyl, $C_7$–$C_{21}$ branched alkenyl, and mixtures thereof; $R^1$ is ethylene; $R^2$ is $C_3$–$C_4$ linear alkyl, $C_3$–$C_4$ branched alkyl, and mixtures thereof; $R^3$ is hydrogen, $C_1$–$C_4$ linear alkyl, $C_3$–$C_4$ branched alkyl, and mixtures thereof; $R^4$ is hydrogen, $C_1$–$C_4$ linear alkyl, $C_3$–$C_4$ branched alkyl, and mixtures thereof; in is 1 or 2, n is 0 or 1, provided that when m is 1 n is 1 and when m is 2 n is 0; x is from 0 to about 50; y is from 0 to about 10; to a rinse-added fabric softener premix, said premix comprising:

a) from about 1% to about 80% by weight, of a fabric softening active, and said principal solvent is selected from the group consisting of $C_6$ diols, $C_7$ diols, the isomers of octanediol, derivatives of butanediol, the isomers of trimethylpentanediol, the isomers of ethylmethylpentanediol, the isomers of propylpentanediol, the isomers of dimethylhexanediol, the isomers of ethylhexanediol, the isomers of methylheptanediol, the isomers of octanediol, the isomers of nonanediol, alkyl glyceryl ethers, di(hydroxy alkyl) ethers, aryl glyceryl ethers, the derivatives of alicyclic diols, derivatives of alkoxylated $C_3$–$C_7$ diols, aryl diols, and mixtures thereof;

b) from 2% to about 15% by weight, of a principal solvent, said principal solvent having a ClogP of from about 0.15 to about 1; and c) the balance carriers and adjunct ingredients.

23. A method for providing softness to fabric comprising the step of contacting said fabric with an aqueous solution containing a rinse-added fabric softening composition comprising:

a) from about 1% to about 80% by weight, of a fabric softening active;

b) from 2% to about 15% by weight, of a principal solvent, said principal solvent having a ClogP of from about 0.15 to about 1, and said principal solvent is selected from the group consisting of $C_6$ diols, $C_7$ diols, the isomers of octanediol, derivatives of butanediol, the isomers of trimethylpentanediol, the isomers of ethylmethylpentanediol, the isomers of propylpentanediol, the isomers of dimethylhexanediol, the isomers of ethylhexanediol, the isomers of methylheptanediol, the isomers of octanediol, the isomers of nonanediol, alkyl glyceryl ethers, di(hydroxy alkyl) ethers, aryl glyceryl ethers, the derivatives of alicyclic diols, derivatives of alkoxylated $C_3$–$C_7$ diols, aryl diols, and mixtures thereof;

c) from about 0.5% to about 10% by weight, of a polyoxyalkylene alkyl amide surface active agent; and d) the balance carriers and adjunct ingredients.

* * * * *